United States Patent [19]

Nagy et al.

[11] Patent Number: 4,792,126

[45] Date of Patent: Dec. 20, 1988

[54] BLOW LANCE FOR TREATING MOLTEN METAL IN METALLURGICAL VESSELS

[75] Inventors: Gábor Nagy, Miskolc; Zoltán Szőnyi, Budapest; Lajos Mityók; István Prágay, both of Miskolc; József Zámbó, Budapest, all of Hungary

[73] Assignee: Vasipari Kutato es Fejleszto Vallalat, Hungary

[21] Appl. No.: 24,882

[22] Filed: Mar. 12, 1987

Related U.S. Application Data

[63] Continuation of Ser. No. 854,740, Apr. 21, 1986, abandoned, which is a continuation of Ser. No. 712,999, Mar. 18, 1985, abandoned.

[51] Int. Cl.[4] ..... C21C 5/48

[52] U.S. Cl. ..... 266/270; 266/225

[58] Field of Search ..... 266/225, 270

[56] References Cited

U.S. PATENT DOCUMENTS 4,097,030 6/1978 Desaar ..... 266/225
4,296,921 10/1981 Hayashi ..... 266/270

FOREIGN PATENT DOCUMENTS 563012 7/1944 United Kingdom ..... 266/270

*Primary Examiner*—L. Dewayne Rutledge
*Assistant Examiner*—Robert L. McDowell
*Attorney, Agent, or Firm*—Handal & Morofsky

[57] ABSTRACT

A blow lance for treating molten metal comprising a concentric metal pipe structure enclosed within a ceramic covering with a space defined between the pipe structure and the covering. A layer of heat-resistant elastic fibrous material, excluding a binder, is positioned in the space. Ducting means forming coolant ducts are located between the concentric pipes.

11 Claims, 2 Drawing Sheets

BLOW LANCE FOR TREATING MOLTEN METAL IN METALLURGICAL VESSELS

This application is a continuation of application Ser. No. 854,740, filed Apr. 21, 1986, abandoned, which is a continuation of our application Ser. No. 712,999, filed Mar. 18, 1985, now abandoned.

FIELD AND BACKGROUND OF THE INVENTION

The present invention relates to a blow lance for treating molten metal in metallurgical vessels, consisting of a metal tube provided with refractory ceramic lining.

In the course of the development of metallurgy, and as a result of the efforts to increase the dimensions, capacity and specific output of the metallurgical installations, several steel treatments outside the vessels have been developed during the last decade. These processes are used particularly for deoxidation and desulfurization of the steels.

The idea of admitting the powdery materials into the molten metal resulted from the efforts aimed at the saving of material, as well as at the more efficient execution of the process, but certain technological functions can be carried out only this way in the practice.

The admission of such powder, or granular materials into the molten bath takes place with the aid of injection systems.

The injection systems include a blow lance for injecting various gases and /in given cases powdery or granular agents/ below the surface of the melt.

The known blow lances generally consist of a thick-walled copper tube provided with refractory lining.

In the course of producing the so-called once-operated lance type, a self-setting fireproof composition is applied onto the surface of the copper tube, then tube pieces similarly made of refractory clay, generally of chamotte are pulled over the composition. This is followed again by the application of fireproof composition and by drying of the lining.

The multi-operated lances are produced in such a manner, that liquid refractory clay containing over 80% $Al_2O_3$ is poured over the copper tube, then it is baked.

The fundamental disadvantage of both lance types is that they are extremely rigid and brittle, which frequently leads to failure during operation. Namely the hot molten metal is never in static condition, the immersed lance is set into vibration, thus cracks appear on the lining, after which the lance becomes useless with a fairly short time.

The considerable difference between the coefficients of thermal expansion of the thick-walled copper tube and the lining results similarly in a tendency to crack. Since the two layers are in contact with each other, and they become fairly hot during immersion into the hot molten metal, cracks appear merely as a result of the difference between the coefficients of thermal expansion.

Further difficulty is due to the intensive heating of the blow lances, since the temperature of the molten metals exceeds substantially 1000° C.

SUMMARY AND OBJECTS OF THE INVENTION

Consequently, the object of the present invention is to develop a blow lance, which is less rigid than the conventional one, is relatively heat-resistant and, consequently, its working life is much longer than that of the known blow lances.

According to the invention, the metal tube of the blow lance is provided with a coolant duct between the layers, in addition a heat-resistant elastic layer is arranged between the metal tube and the ceramic covering.

The multi-layered metal tube may consist of an internal transport pipe and an external casing pipe with radial fins in between.

Preferably a turn-chamber is formed in the coolant duct between the transport pipe and casing pipe, for example in such a way, that the fins at the lower part of the lance are shorter than the transport pipe and casing pipe. In another embodiment the coolant duct is formed in such a way that the fins at the lower part are provided with holes.

The coolant ducts may be closed by a bottom plate or pipe extension between the transport pipe and casing pipe. The pipe extension is provided with external thread to fix a plug.

The heat-resistant elastic layer between the metal tube and lining may be asbestos cord wound around the metal tube, while the lining may be formed with a single cast layer, or cast layers and chamotte tubes.

The blow lances according to the invention are considerably more flexible than the conventional ones, because of the elastic layer between the metal tube and the lining. Accordingly the lining is not exposed to the effect caused by the different coefficients of thermal expansion, and it is more resistant to the external mechanical effects.

Furthermore, a fundamental advantage of the invention is that the metal tube is formed with several layers having coolant ducts between them. Obviously, this considerably reduces the heat load of the blow lance.

In view of the foregoing, the working life of the blow lances according to the invention is much longer than that of the conventional ones, which represents substantial saving on the given field, not only because of the less intensive wear, but mainly because the number of defective casting can be substantially reduced, which is especially significant in respect of the ladle dimensions.

BRIEF DESCRIPTION OF THE DRAWINGS

Further details of the present invention will become more apparent from the following description of preferred embodiments of the invention, when taken in conjunction with the accompanying drawings, in which.

DESCRIPTION OF THE PREFERRED EMBODIMENTS

Figure 1:
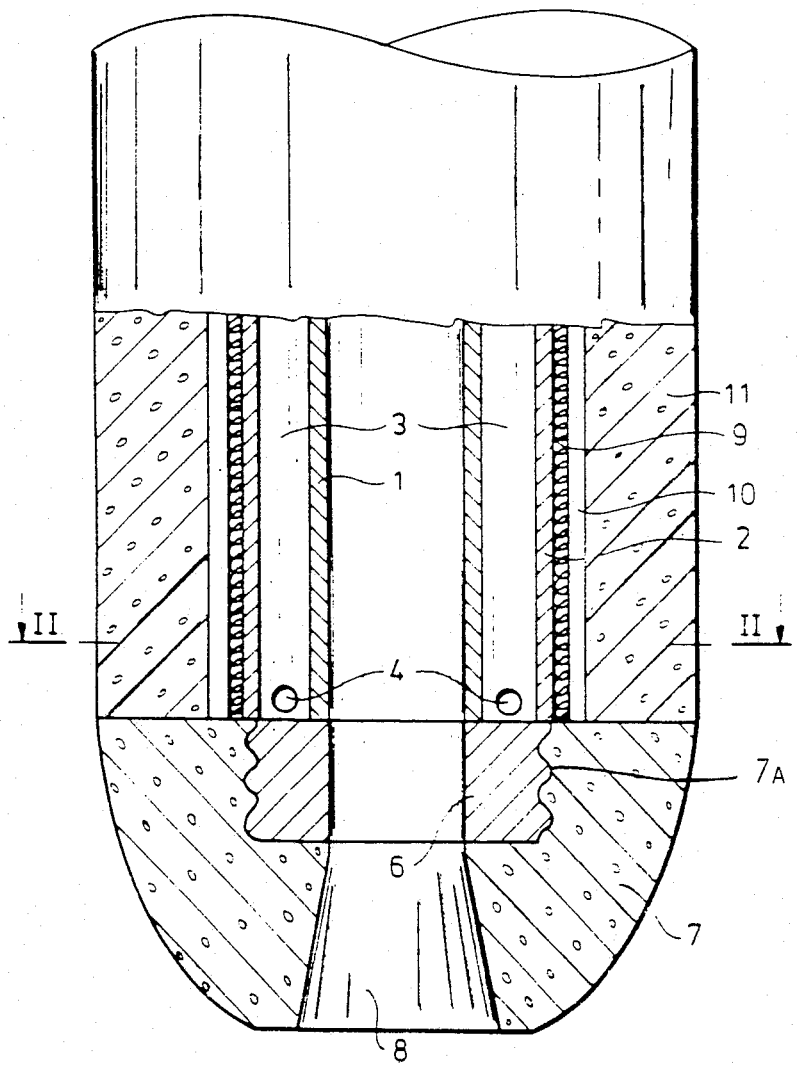
FIG. 1 is a partial sectional view of the blow lance according to the invention.
Figure 2:
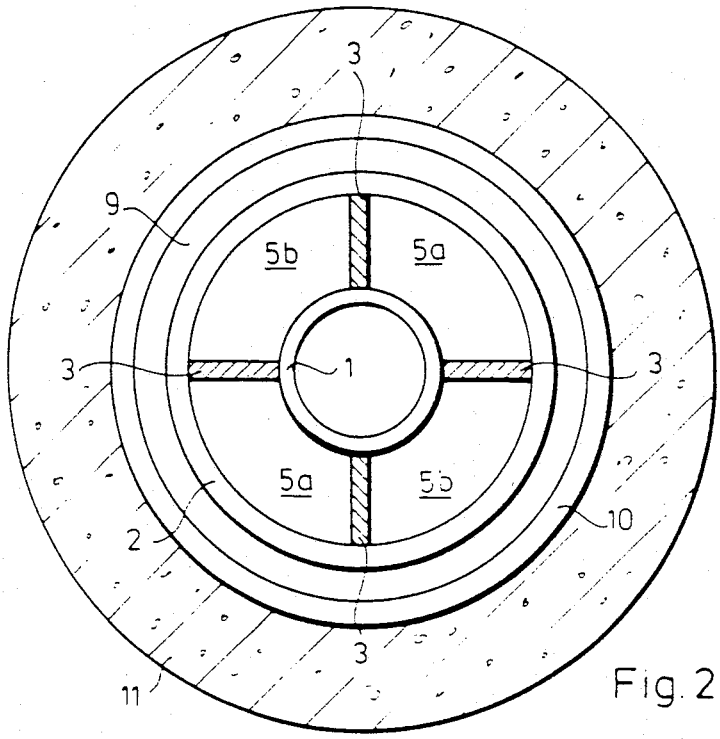
FIG. 2 is a section along line II—II of the blow lance shown in FIG. 1

Transport pipe 1 and casing pipe 2 are concentrically arranged inside the blow lance as shown in FIG. 1. The transport pipe 1 and casing pipe 2 are interconnected by radial fins 3. The fins 3 are welded to the transport pipe 1 and casing pipe 2. Holes 4 are formed on the lower part of the fins 3 for transfer of the coolant between the parallel ducts and act as turn-around chambers. FIG. 2 which is the sectional view of FIG. 1 clearly demonstrates that in this construction the space between the pipes is divided into four parts. The ducts 5*a* guide the coolant downstream, the ducts 5*b* upstream, meanwhile the coolant flows through the holes 4 form ducts 5*a* to ducts 5*b*.

Blocking stub 6 is welded to the transport pipe 1 and casing pipe 2 on the lower part of the blow lance, which partly blocks the lower part of ducts 5*a* and 5*b*, and partly fixes a plug 7 by the thread 7*a* forged onto the jacket. Plug 7 forms the tip of the blow lance and is provided with a central nozzle coaxial with the duct of the transport pipe and blocking stub 6.

Asbestos cord is wound around the jacket of the casing pipe 2, and this forms the elastic layer 9.

Self-setting refractory clay is applied on these layers as the next layer 10.

Chamotte tube pieces 11 are pulled over the blow lance as cover layers.

Figure 3:
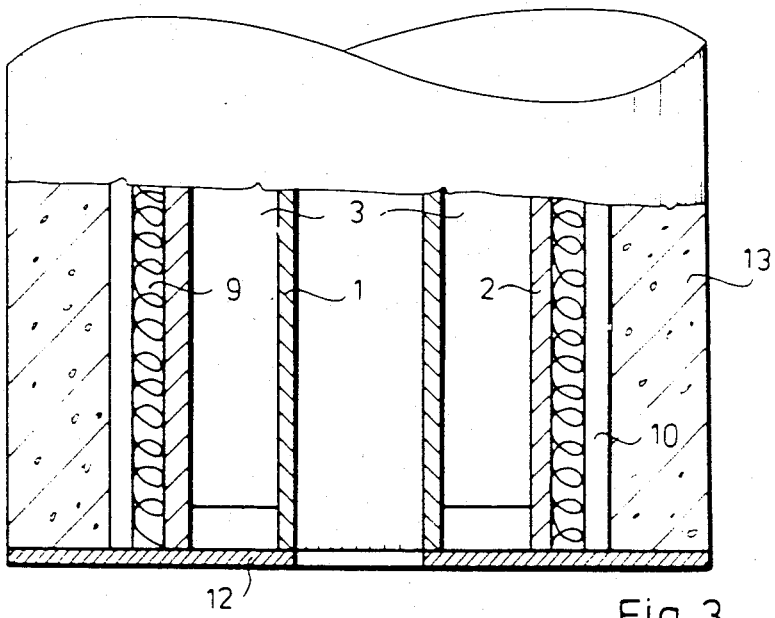
FIG. 3 is an alternative construction of the blow lance according to the invention.

Another embodiment of the blow lance according to the invention is shown in FIG. 3. Here the interior of the blow lance is also built up from transport pipe 1 and casing pipe 2, as well as with fins 3 welded in between. The lower part of the blow lance is surrounded by a bottom plate 12, welded to the transport pipe 1 and casing pipe 2. The bottom plate 12 closes the coolant ducts between the transport pipe 1 and casing pipe 2, and it holds the layers 10 and 13 applied on the elastic layer formed suitably as in the solution shown in FIG. 1.

The layer 10 is made of self-setting refractory clay, and the layer 13 is fireproof concrete containing about 80% $Al_2O_3$, which is cast in template over the layer 10.

The turn-chambers of the coolant ducts are shaped so that the fins 3 are shorter than the transport pipe 1 and casing pipe 2, thus the medium is capable to flow from one duct into the other one between the lower edge of the fins 3 and the bottom plate 12.

The embodiments shown in the Figures were extremely effective in the practice, whereby such technology was realized, which could not be solved at all with the earlier blow lances. With the extremely resistant and flexible blow lances according to the invention it became possible to start the injection already during the tapping. This means, that the blow lance is introduced into the casting ladle before starting the tapping, and when the tapping begins, the injection can also be started.

Since under these conditions the lance is exposed to the simultaneous mechanical and heat effects of the hot molten metal, such technology could not be realized at all with the earlier ones. The lances according to the invention were capable to endure this effect without damage, and in this way it was possible to carry out the injection in the molten steel falling down from a height of about 6 meters for 5 to 10 minutes. After casting, the injection is continued usually for about 15–20 minutes, then further injection can be carried out during and/or after the casting.

The lance according to the invention can be effectively used either for the conventional injection full ladle or into a converter. It is characteristic to its durability, that while four lances had to be used on the average for treatments carried out with conventional lances, of the best possible types, on the other hand, with the lance according to the invention, even 15 charges could be treated without difficulty.

Similarly it is characteristic, that during the treatment carried out with the lance according to the invention, the injection takes place into a 120 ton ladle, and during the treatment of 40 charges, wastage due to faulty lance occurred only once.

In view of the foregoing it can be clearly seen, that the blow lance according to the invention ensures a much longer working life not only during the treatments carried out with conventional technology, and thus a less expensive one, but it enables also the application of such new technologies, which were not realizable with the lances known earlier.

Though the presented examples describe only two embodiments of the lance according to the invention, it is evident for those skilled in the art that the specialist is capable to develop several similar alternatives.

What we claim is:

1. A blow lance for treating molten metal in metallurgical vessels comprising a concentric metal pipe structure enclosed within a refractory ceramic covering, said pipe structure and said ceramic covering defining a space therebetween, said metal pipe structure being formed of inner and outer metal pipes, and ducting means for forming coolant ducts between said inner and outer pipes and a heat-resistant elastic layer consisting of an elastic fibrous material and excluding any binder material, said elastic layer being positioned in said space which is between an outer surface of said outer pipe and an inner surface of said refractory covering.

2. A blow lance as claimed in claim 1, wherein said inner pipe is a transport pipe and said outer pipe is a casing pipe and said ducting means comprising radial fins disposed therebetween.

3. A blow lance as claimed in claim 2, wherein turn-chambers are formed by holes arranged on the bottom of the fins.

4. A blow lance as claimed in claim 3, wherein the fins for each turn-chamber are formed shorter on the lower part of the lance, than the transport pipe and casing pipe.

5. A blow lance as claimed in claim 2, wherein blocking stub is fixed to the lowr part of the transport pipe and casting pipes.

6. A blow lance as claimed in claim 5, wherein the blocking stub is provided with threads on the jacket onto which a plug is screwed.

7. A blow lance as claimed in claim 1, wherein the ducting means functions as turn-chambers.

8. A blow lance as claimed in claim 1, wherein the elastic layer is made of asbestos cord.

9. A blow lance as claimed in claim 1, wherein said ceramic covering comprises an inner layer of self-setting refractory clay disposed over the elastic layer.

10. A blow lance as claimed in claim 9, wherein said ceramic covering comprises an outer layer of chamotte tubes disposed over the layer made from self-setting refractory clay.

11. A blow lance as claimed in claim 9, wherein said ceramic covering comprises an outer fireproof cast concrete layer containing $Al_2O_3$ disposed over the layer made from self-setting refractory clay.

* * * * *